US008134298B2

(12) United States Patent
Yang

(10) Patent No.: US 8,134,298 B2
(45) Date of Patent: Mar. 13, 2012

(54) DECORATIVE LIGHT STRING DEVICE

(75) Inventor: Chen-Sheng Yang, Kaohsiung (TW)

(73) Assignee: Wang Loong Co., Ltd., Kaohsiung (TW)

( * ) Notice: Subject to any disclaimer, the term of this patent is extended or adjusted under 35 U.S.C. 154(b) by 538 days.

(21) Appl. No.: 12/153,089

(22) Filed: May 14, 2008

(65) Prior Publication Data

US 2009/0284159 A1 Nov. 19, 2009

(51) Int. Cl.
*H05B 37/00* (2006.01)

(52) U.S. Cl. ..... 315/185 R; 315/185 S; 315/187; 315/201; 315/205

(58) Field of Classification Search ..... 315/185 R, 315/187–189, 185 S, 200 R, 201, 205; 362/800, 362/806

See application file for complete search history.

(56) References Cited

U.S. PATENT DOCUMENTS

| | | | | |
|---|---|---|---|---|
| 6,984,984 | B2 * | 1/2006 | Frederick et al. | 324/414 |
| 7,377,802 | B2 * | 5/2008 | Allen | 439/490 |
| 7,481,555 | B2 * | 1/2009 | Huang et al. | 362/249.06 |
| 7,518,316 | B2 * | 4/2009 | Yu | 315/200 R |
| 2006/0007679 | A1 * | 1/2006 | Allen | 362/227 |

* cited by examiner

*Primary Examiner* — Thuy Vinh Tran
(74) *Attorney, Agent, or Firm* — Rosenberg, Klein & Lee

(57) ABSTRACT

The present invention discloses a decorative light string device, which comprises: a power plug receiving AC power, a tail socket coupled to the power plug, and a LED string with one end thereof coupled to the power plug and the other end thereof coupled to the tail socket, wherein each of the power plug and tail socket has a diode and a capacitor coupled to the diode, whereby a DC voltage, which is twice the peak voltage of the AC power, is output to the LED string.

4 Claims, 3 Drawing Sheets

DECORATIVE LIGHT STRING DEVICE

BACKGROUND OF THE INVENTION

1. Field of the Invention

The present invention relates to a decorative light string device, particularly to a decorative light string device having a voltage-doubling design.

2. Description of the Related Art

LED (Light Emitting Diode) emits light when electrons and holes recombine in a semiconductor material, wherein electrons drop to a lower energy level with light energy released. LEDs with different forbidden bands provide different colors of light. Currently, LEDs have been able to provide lights of a full color spectrum. Compared with the traditional lamp bulbs, LED has the advantages of luminescence, small size, fast response, drop proof, and high power efficiency. Therefore, LED has been extensively used in many products.

For example, LED has been widely used in decorative light strings. Refer to FIG. 1 for a conventional decorative light string device 10, which comprises: a power plug 12, a tail socket 14 coupled to the power plug 12, and a power converter 16 coupled to the power plug 12 and a LED string 18. The power converter 16 converts AC (Alternating Current) power into DC (Direct Current) power, and the DC power is supplied to the LED string 18.

When the original voltage is maintained, increasing the LED number of the LED string will decrease LED brightness. Only via raising voltage can the LED number of the LED string be increased without decreasing LED brightness. However, raising voltage increases power consumption and electric expense.

Accordingly, the present invention proposes a novel decorative light string device to solve the abovementioned problems.

SUMMARY OF THE INVENTION

One objective of the present invention is to provide a decorative light string device, wherein the number of LEDs in the LED string is increased with brightness maintained without increasing the input voltage via a voltage-doubling circuit design, whereby the cost of the decorative light string device is reduced.

The present invention proposes a decorative light string device, which comprises: a power plug receiving AC power, a tail socket coupled to the power plug, and a LED string with one end coupled to the power plug and the other end coupled to the tail socket, wherein the power plug has a first diode and a first capacitor coupled to the first diode, and the tail socket has a second diode and a second capacitor coupled to the second diode, whereby a DC voltage, which is twice the peak voltage of the AC power, is output to the LED string.

This and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed

DETAILED DESCRIPTION OF THE INVENTION

Figure 1:
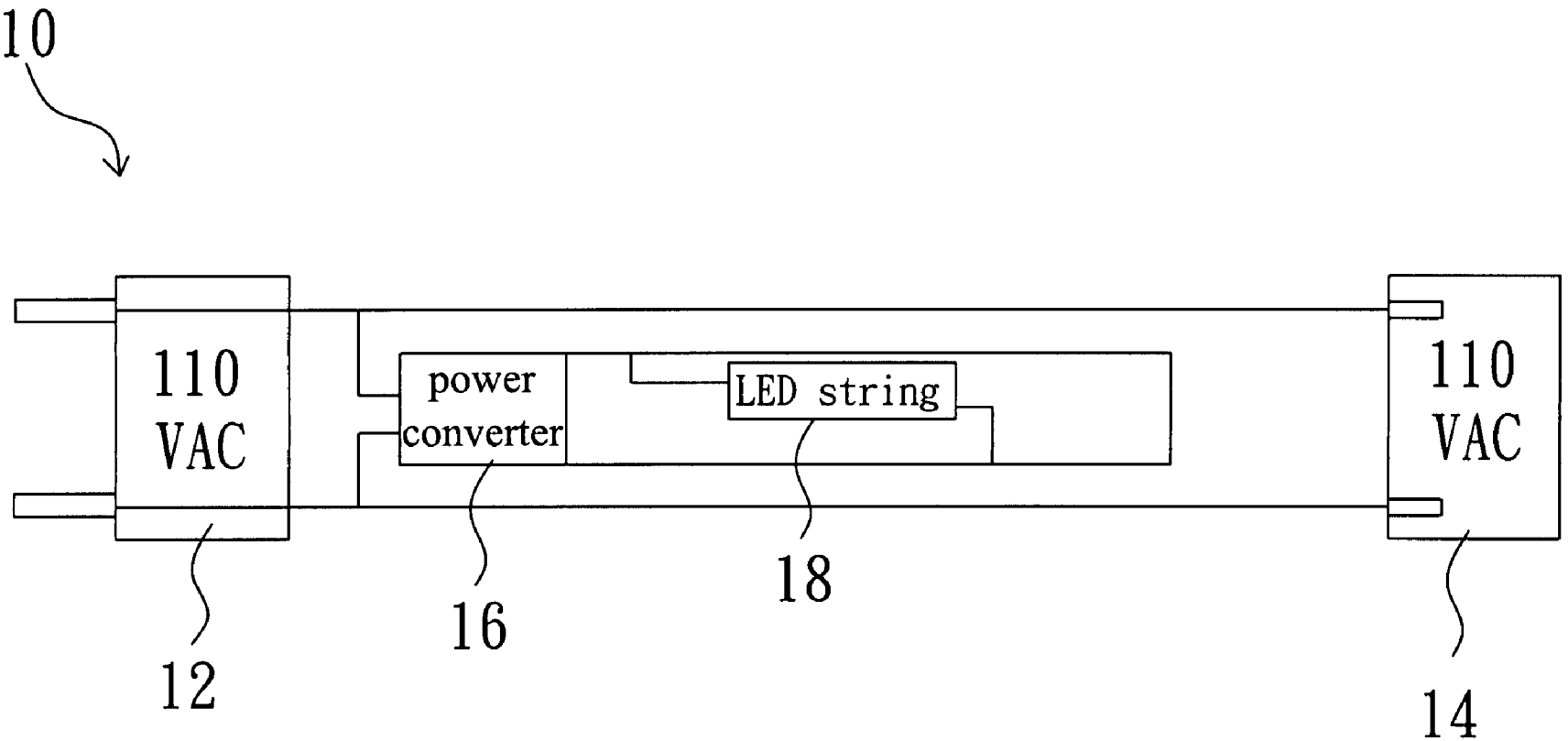
Fig. 1 (prior art)
FIG. 1 is a diagram schematically showing the structure of a conventional decorative light string device.
Figure 2:
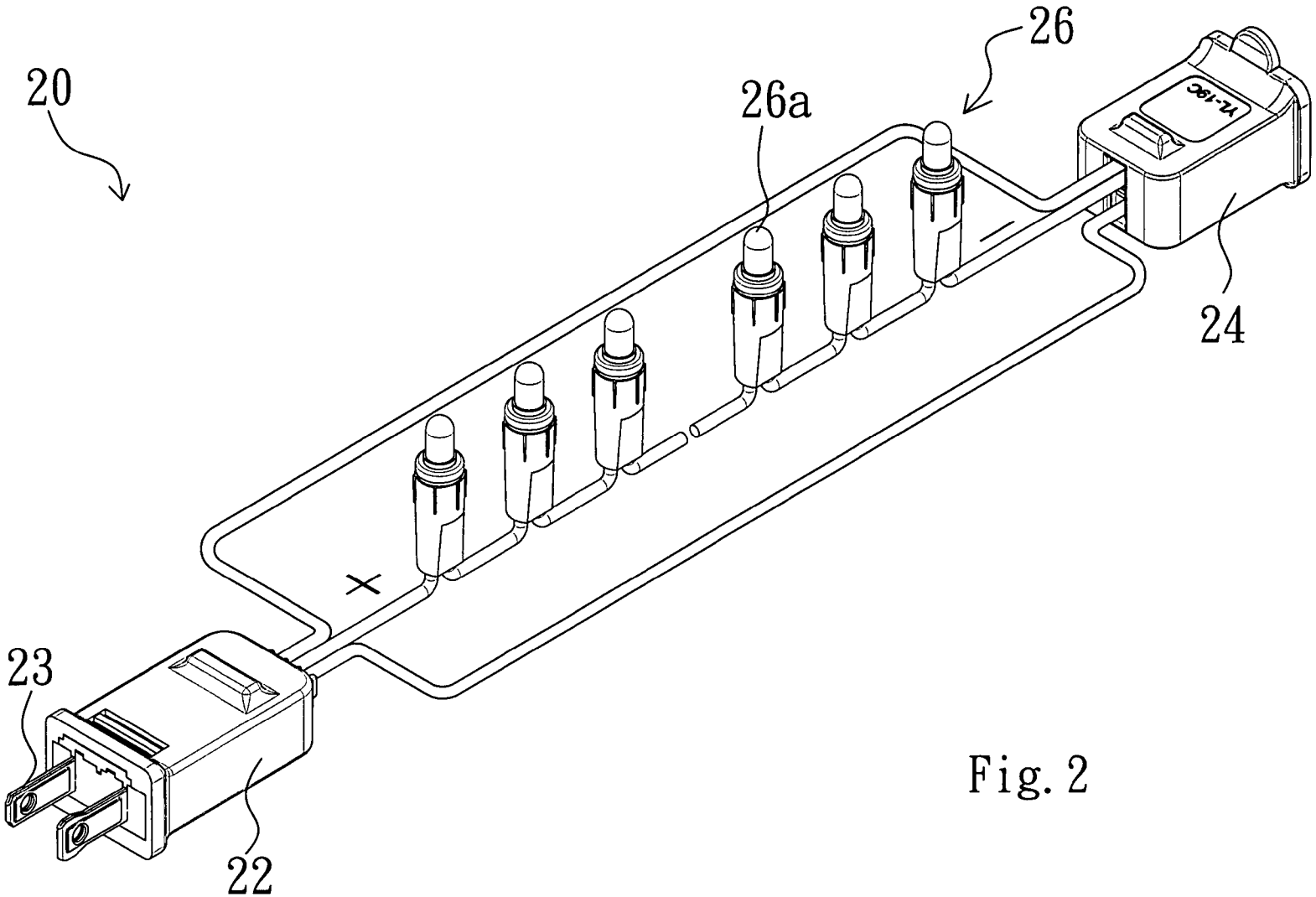
FIG. 2 is a perspective view schematically showing a decorative light string device according to the present invention.

Refer to FIG. 2 a perspective view schematically showing the appearance of a decorative light string device according to the present invention. The decorative light string device 20 of the present invention comprises: a power plug 22 having a pair of conductive insert plates 23, a tail socket 24 coupled to the power plug 22, and a LED string 26 having a plurality of LEDs 26*a* with one end thereof coupled to the power plug 22 and the other end thereof coupled to the tail socket 24. The tail socket 24 may be further connected with another plug. The LED 26*a* is a white-light LED, a red-light LED, a blue-light LED, a green-light LED, a yellow-light LED, or a LED with another color.

Figure 3:
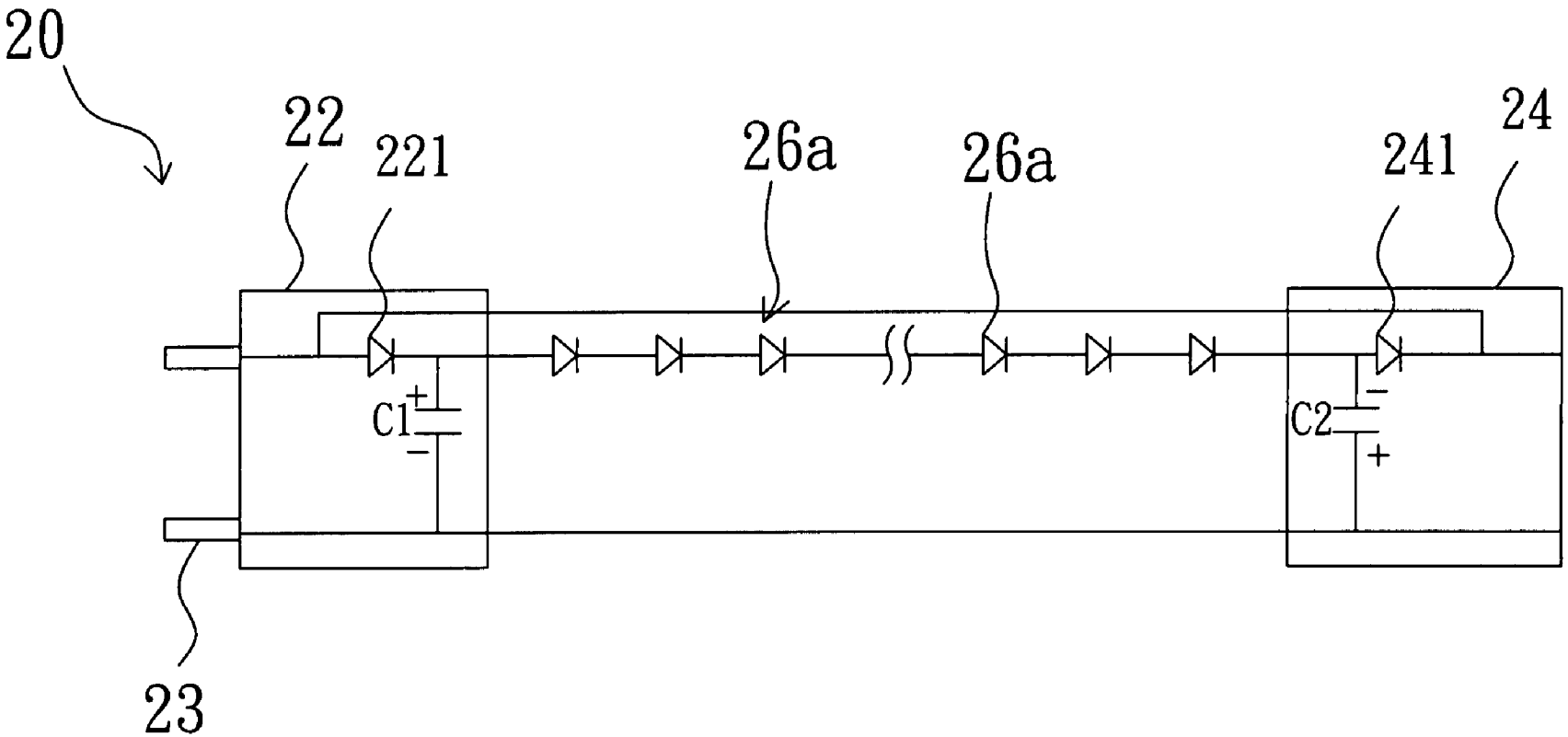
FIG. 3 is a diagram schematically showing the circuit of a decorative light string device according to the present invention.

Refer to FIG. 3 a diagram schematically showing the circuit of a decorative light string device according to the present invention. The power plug 22 has a diode 221 functioning as a rectifier and a capacitor C1 coupled to the diode 221. The tail socket 24 has a diode 241 functioning as a rectifier and a capacitor C2 coupled to the diode 241, wherein the capacitors C1 and C2 have identical capacitances and are used to store electric charges and filter. The power plug 22 receives AC power via the conductive insert plates 23; the diode 221 rectifies the AC current to charge the capacitor C1 to output a DC voltage, which is twice the peak voltage of the AC power to the LED string 26. Similarly, the tail socket 24 receives AC power from the power plug 22; the diode 241 rectifies the AC current to charge the capacitor C2 to output a DC voltage, which is twice the peak voltage of the AC power to the LED string 26. Thus, the LED number of the LED string 26 can be doubled.

In conclusion, the present invention respectively installs the voltage-doubling circuits consisting of a diode and a capacitor in the power plug and the tail socket to provide a DC voltage which is twice the voltage of the AC power for the LED string, whereby LED brightness is enhanced or the LED number is increased without increasing the input voltage or raising the cost.

The embodiment described above is to exemplify the present invention to enable the persons skilled in the art to understand, make and use the present invention. However, it is not intended to limit the scope of the present invention. Therefore, any equivalent modification or variation according to the spirit of the present invention is to be also included within the scope of the present invention.

What is claimed is:

1. A decorative light string device, comprising:

a power plug receiving AC (Alternating Current) power, a tail socket coupled to said power plug, and a LED (Light Emitting Diode) string with one end thereof coupled to said power plug and another end thereof coupled to said tail socket, wherein said power plug has a first diode and a first charging capacitor coupled to said first diode to define a first charging polarity thereacross; and said tail socket has a second diode and a second charging capacitor coupled to said second diode to define a second charging polarity opposite said first charging polarity thereacross, each of said first and second diodes having an node and cathode terminals, one of said first and second charging capacitors being coupled to said LED strings and the cathode terminal of said diode corresponding thereto, and the other of said first and second charging capacitors being conversely coupled to said LED string and the anode terminal of said diode corresponding thereto, whereby a DC (Direct Current) voltage substantially twice a peak voltage of said AC power voltage, is generated across said LED string; and, wherein said first capacitor, said first diode, said second capacitor, and said second diode are directly coupled to said LED string.

2. The decorative light string device according to claim 1, wherein said LED string has a plurality of LEDs and each said LED is a white-light LED, a red-light LED, a blue-light LED, a green-light LED, a yellow-light LED, or an LED of another color.

3. The decorative light string device according to claim 1, wherein said tail socket is coupled to receive the AC power.

4. The decorative light string device according to claim 1, wherein said first charging capacitor is coupled to a cathode terminal of said first diode, and said second charging capacitor is coupled to the anode terminal of said second diode.

* * * * *